United States Patent [19]

Ferguson et al.

[11] 4,334,461

[45] Jun. 15, 1982

[54] PORTABLE WINDOW DRYER VENT

[76] Inventors: Arthur Ferguson, c/o George Spector, 3615 Woolworth Bldg., 233 Broadway; George Spector, 3615 Woolworth Bldg., 233 Broadway, both of New York, N.Y. 10007

[21] Appl. No.: 94,449

[22] Filed: Nov. 15, 1979

[51] Int. Cl.[3] ..... F24F 13/18

[52] U.S. Cl. ..... 98/119; 34/235; 98/99.7; 285/189

[58] Field of Search ..... 98/95, 99 L, 99.7, 118, 98/119, DIG. 7; 34/235; 285/189

[56] References Cited

U.S. PATENT DOCUMENTS

| | | | |
|---|---|---|---|
| 941,917 | 11/1909 | Fulton | 98/99 R X |
| 1,510,265 | 9/1924 | Filkins | 126/317 |
| 2,348,455 | 5/1944 | Daudelin | 98/DIG. 7 |
| 3,185,506 | 5/1965 | Szlashta | 285/189 X |
| 3,285,155 | 11/1966 | Maltenfort | 98/119 |
| 4,081,915 | 4/1978 | Babcerowicz et al. | 34/235 |
| 4,151,789 | 5/1979 | Grobard | 98/119 |

*Primary Examiner*—William E. Wayner
*Assistant Examiner*—Harold Joyce

[57] ABSTRACT

A portable window vent screen that includes a large hole therethrough with a ventilator adjacent its outer side bolted to an adapter on its inner side, and a flexible hose from a gas or electric dryer being detachably attachable to the adapter whenever the dryer is used, so as to move humid air from the dryer outwardly of the house.

2 Claims, 2 Drawing Figures

PORTABLE WINDOW DRYER VENT

This invention relates generally to Ventilating devices.

It is well known that a gas or electric dryer produces moist or humid air that must be vented outward of a house in order to not create dampness and growth of mildew that result in a musty odor. While home owners can readily break a hole in a wall or remove a window pane for installation of a vent therethrough for the dryer, such solution is not possible to tenants renting an apartment or house and who possess a gas or electric dryer. This situation is therefore in need of an improvement.

Accordingly, it is a principal object of the present invention to provide a window dryer vent that is portable so that it can be installed in the window whenever the dryer is wished to be used, the vent allowing moist air from the dryer to be carried out of the house without need to break through a wall or remove a window pane.

Figure 1:
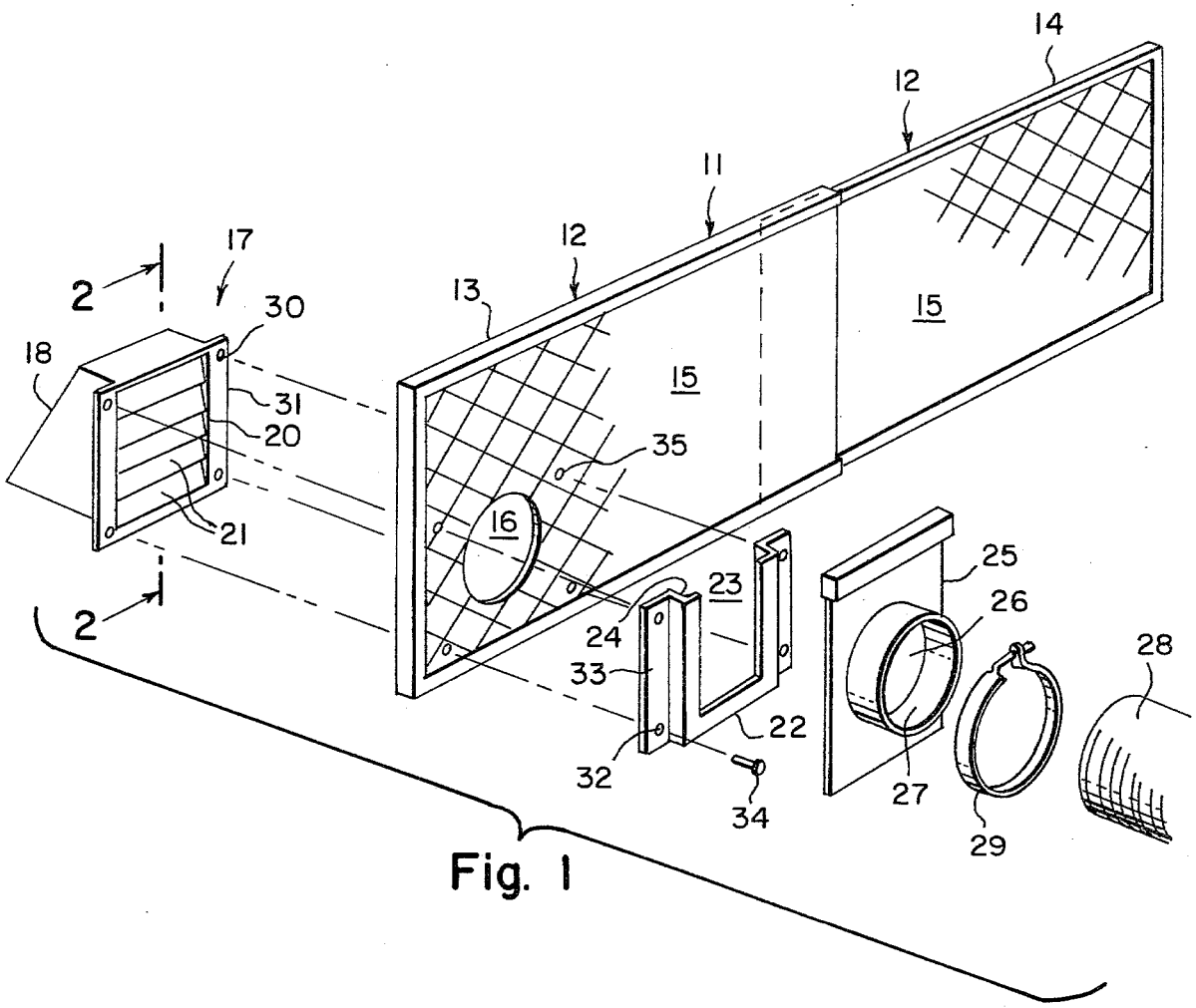
FIG. 1 is an exploded perspective view of the invention components shown in related position for assembly.
Figure 2:
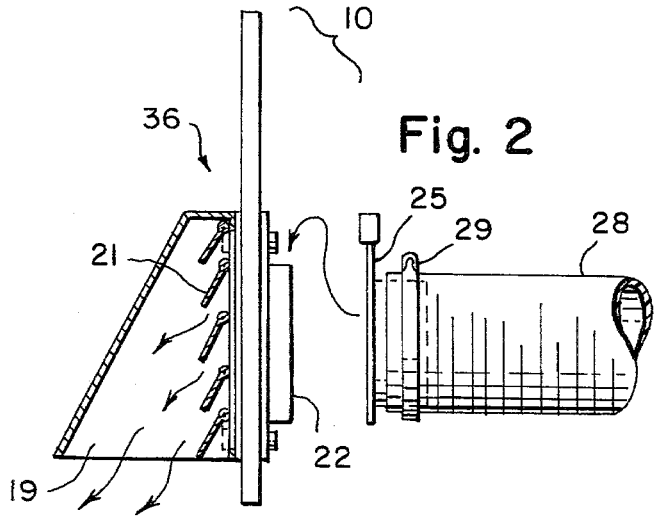
FIG. 2 is a cross sectional view on line 2—2 of FIG. 1, showing the invention assembled.

Referring now to the drawing in greater detail, the reference numeral 10 represents a portable window dryer vent according to the present invention wherein there is a collapsible window screen 11 comprised of two interslidable panels 12 so that the screen can be snugfitted in different widths of windows. One panel includes a frame 13 of channel shape so that the narrow frame 14 of the other panel slides therein. Each frame is fitted with either a mesh screening 15, or other paneling such as a solid transparent pane of plastic, masonite, or the like. A large hole 16 is cut in one of the panels, the hole being located near one end of the screen where it is not likely to be covered by the other sliding panel.

An air exhaust vent 17 is positioned adjacent an outer side of the hole, the vent comprising a box 18 having an opening 19 on its bottom and an opening 20 at its rear which is closable by freely depending, pivotable flaps or louvers 21.

An adapter 22 is positioned adjacent an inner side of the hole 16 and has a notch 23 so to clear the hole from blockage thereof. A groove 24 around opposite side and lower edges thereof serves to hold the edges of a rectangular plate 25 removably slidable into the adapter.

The plate 25 includes a central hole 26 therethrough which is a same size as hole 16. An inwardly extending flange 27 surrounds the edge of hole 26, so that an accordion pleated hose 28 from a dryer can be fitted around the flange and permanently secured thereto by means of a conventional hose clamp 29, so that the plate 25 remains permanently with the base.

Holes 30 are provided on side flanges 31 of the vent 17 and correspondingly located holes 32 are provided on side flanges 33 of the adapter so that bolts 34 can be fitted therethrough and through holes 35 of the screen, vent and adapter as a single and permanent unit 36.

In operative use, the lower sash of a room window is simply raised enough so that the unit 36 can be fitted therebeneath and the screen panels are sidewardly slided so to fill the entire space formed by the raised window. The plate 25 is then just slided into the adapter and the dryer is then ready for use.

The vent, adapter and plate of the invention may be made either from fabricated sheet metal, or they may be molded from a hard plastic, as preferred by a manufacturer. If made of semi flexible plastic, the vent can be accordian pleated so that it could be horizontally stretched and provided with a brace for retaining it in stretched condition so that the bottom opening 19 thereof is located a greater distance away from the screen. Thus if the screen paneling comprises mesh screening, the discharged moist air is less likely to enter the room through the screening.

What is claimed is:

1. A portable window dryer vent unit comprising a window insert assembly adapted for removable insertion in a window opening, said assembly comprising a screen with a bracket mounted on the inner side of said screen and an exterior exhaust vent mounted on the outer side of said screen in alignment with said bracket, said vent and bracket including means extending through said screen securing said bracket and vent on said screen, including an opening through said screen aligned with an opening through said bracket and the inlet to said vent in further combination with a plate removably mounted on said bracket having a flange surrounding an outlet through said plate aligned with said opening through said screen, in further combination with means for mounting a hose on said flange.

2. A unit such as in claim 1 wherein said bracket includes a slot adapted to receive said plate in a position aligning said openings.

* * * * *